US009233296B2

(12) United States Patent
Allenspach et al.

(10) Patent No.: US 9,233,296 B2
(45) Date of Patent: Jan. 12, 2016

(54) BINDING SYSTEMS FOR BOARDS AND SKIS

(71) Applicant: OB4 SYSTEMS, INC., Canton, GA (US)

(72) Inventors: Eric J. Allenspach, Canton, GA (US); Marianne Allenspach-Boller, Canton, GA (US); Tommy Michael Mosley, Talking Rock, GA (US)

(73) Assignee: OB4 Systems, Inc., Canton, GA (US)

( * ) Notice: Subject to any disclaimer, the term of this patent is extended or adjusted under 35 U.S.C. 154(b) by 0 days.

(21) Appl. No.: 14/187,802

(22) Filed: Feb. 24, 2014

(65) Prior Publication Data

US 2015/0238843 A1 Aug. 27, 2015

(51) Int. Cl.

| | |
|---|---|
| ***A63C 9/086*** | (2012.01) |
| ***A63C 10/12*** | (2012.01) |
| ***A63C 10/10*** | (2012.01) |
| ***A63C 10/18*** | (2012.01) |

(52) U.S. Cl.

CPC ..... *A63C 10/103* (2013.01); *A63C 9/086* (2013.01); *A63C 10/12* (2013.01); *A63C 10/18* (2013.01)

(58) Field of Classification Search

CPC ..... A63C 9/00; A63C 9/086; A63C 10/10; A63C 10/106; A63C 10/12; A63C 10/18; B63B 35/812

See application file for complete search history.

(56) References Cited

U.S. PATENT DOCUMENTS

| | | | | |
|---|---|---|---|---|
| 3,944,237 | A | 3/1976 | Teague, Jr. | |
| 4,125,274 | A * | 11/1978 | Kubelka et al. | 280/618 |
| 4,741,550 | A * | 5/1988 | Dennis | 280/618 |
| 4,973,073 | A * | 11/1990 | Raines et al. | 280/624 |
| 5,054,807 | A * | 10/1991 | Fauvet | 280/607 |
| 5,181,332 | A | 1/1993 | Uren et al. | |
| 5,299,823 | A * | 4/1994 | Glaser | 280/625 |
| 5,499,837 | A | 3/1996 | Hale et al. | |
| 5,690,351 | A | 11/1997 | Karol | |
| 5,695,210 | A * | 12/1997 | Goss et al. | 280/624 |
| 6,213,493 | B1 | 4/2001 | Korman | |
| 6,773,024 | B2 | 8/2004 | Walkhoff | |
| 7,267,357 | B2 | 9/2007 | Miller et al. | |
| 7,918,477 | B2 | 4/2011 | Wischhusen et al. | |
| 8,276,921 | B2 | 10/2012 | Walker | |
| 2011/0227317 | A1 | 9/2011 | Holbird, Jr. | |

* cited by examiner

*Primary Examiner* — Frank Vanaman

(74) *Attorney, Agent, or Firm* — Thomas | Horstemeyer LLP; Randy R. Schoen

(57) ABSTRACT

Various binding systems for sliding boards and skis are presented. In one example, among others, a binding system includes a boot plate assembly affixed to a boot and a mounting plate assembly. The mounting plate assembly can be affixed to a sliding board or a ski. The boot plate assembly includes a socket and a wedge attached to opposite sides of a boot plate. The mounting plate assembly includes a spring mechanism configured to engage the socket and a wedge block configured to receive the wedge. When engaged, pressure from the spring mechanism holds the boot plate assembly to the sliding board or ski. When sufficient force is applied through the boot, the boot plate assembly is released from the mounting plate assembly, which frees the rider from the sliding board or ski.

19 Claims, 7 Drawing Sheets

BINDING SYSTEMS FOR BOARDS AND SKIS

BACKGROUND

Snow and water skiing are enjoyed around the world. There is evidence that snow skiing has been employed in Norway and Sweden since the beginning of recorded history. Recreational downhill skiing has been enjoyed since the mid-1800s and significantly grew in popularity in the 1940s and 1950s. Water skiing was invented in 1920s using a pair of boards as skis and a clothesline as a towrope. Over the years, binding systems for snow and water skis have been refined for safety. Snowboarding developed in the United States during the 1960s and wakeboarding arose during the 1980s. Both snowboarding and wakeboarding have grown in popularity throughout the world.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
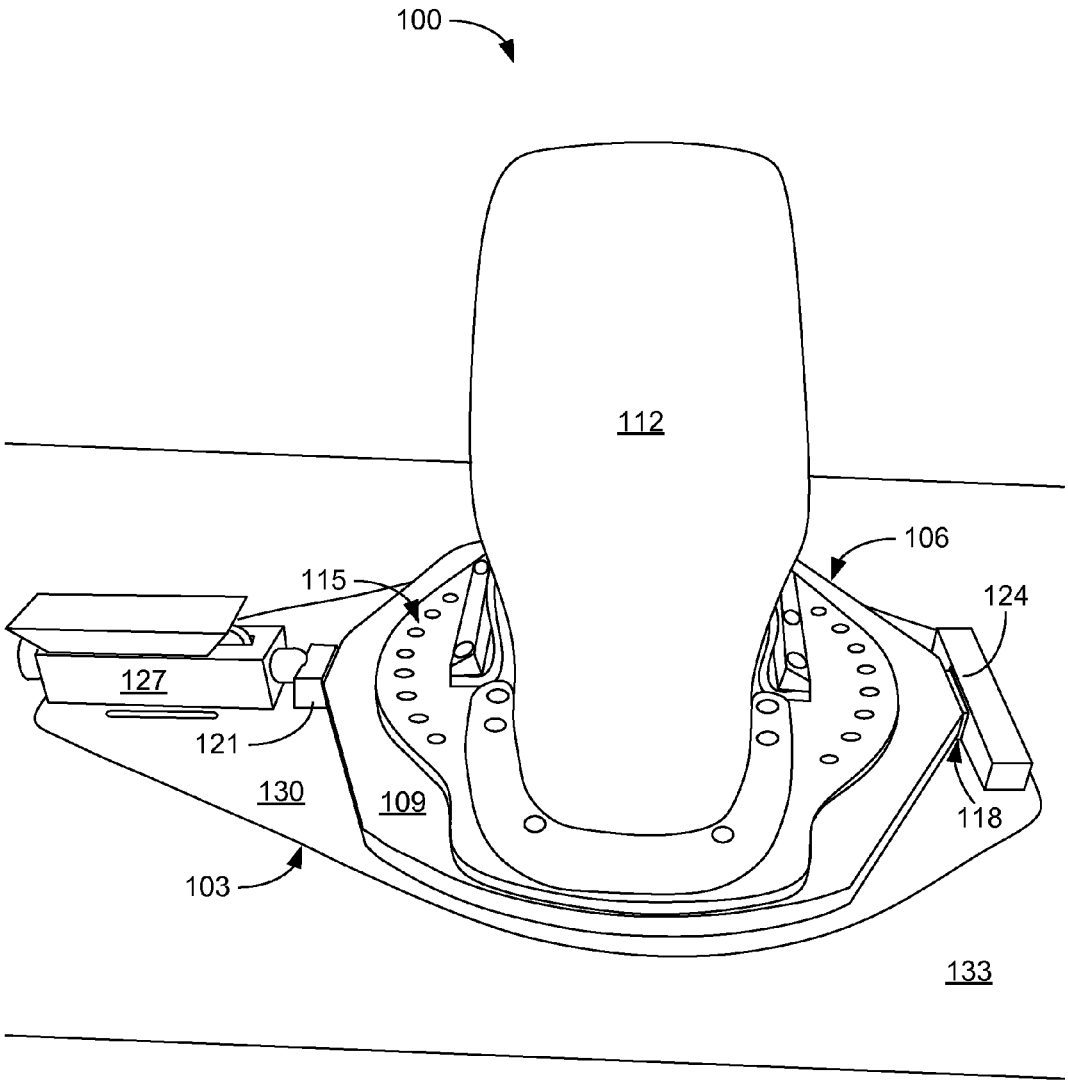
FIG. 1 is a perspective view of an example of a binding system for use on a sliding board in accordance with various embodiments of the present disclosure.

Disclosed herein are various examples related to binding systems for skis and sliding boards. Reference will now be made in detail to the description of the embodiments as illustrated in the drawings, wherein like reference numbers indicate like parts throughout the several views.

Sliding boards are used in a variety of sports such as, e.g., snowboarding and wakeboarding. Snowboards include boards in a variety of shapes and sizes. The board extends along a longitudinal axis from a tail section at one end, through a waist section, to a nose section at the other end. Snowboards are generally constructed of a hardwood core sandwiched between layers of fiberglass. Other materials such as, e.g., carbon fiber, Kevlar and/or aluminum may also be utilized in their construction. The nose and tail sections are normally wider than the waist section. Snowboards can come in several designs including, e.g., freestyle, freeride, powder, all-mountain, racing (or alpine) or others. Bindings are commonly secured to the board using screws to hold the boots of the snowboarder in place to transfer energy to the board. Bindings such as, e.g., strap-in, step-in or hybrid bindings are attached to the board using screws to hold the boots of the snowboarder in a fixed position with respect to the board. A pair of bindings are secured forward and aft of each other along the longitudinal axis of the snowboard so that the foot of the rider extends across the longitudinal axis. The pair of bindings can be equally spaced about the center of the snowboard. Snowboard bindings, unlike ski bindings, do not automatically release upon impact or after falling over.

Wakeboards are buoyant boards with a core made of, e.g., foam, honeycomb or wood mixed with resin and coated with fiberglass. Wakeboard boots are commonly secured to the wakeboard using screws to hold the rider's feet in position. The boots are secured forward and aft of each other along the longitudinal axis of the snowboard so that the foot of the rider extends across the longitudinal axis. The pair of boots can be equally spaced about the center of the snowboard. The configuration and positioning of the boots can be fixed based upon the preference of the wakeboard rider. As with snowboard bindings, wakeboard boots do not automatically release upon impact or after falling over.

Referring to FIG. 1, shown is an example of a releasable binding system 100 that can be used on sliding boards such as, e.g., snowboards and wakeboards. The binding system 100 includes a mounting plate assembly 103 and a boot plate assembly 106. The boot plate assembly 106 includes a boot plate 109 to which a boot 112 is secured. The boot 112 may be, e.g., a wakeboard boot, snowboard boot, ski boot or other appropriate boot. A wedge 118 and a socket 121 are secured to opposite sides of the boot plate 109. The wedge 118 and socket 121 allow the boot plate assembly 106 to be held in position on the mounting plate assembly 103.

FIG. 1 shows a perspective view from the back of the boot 112. The boot 112 may be secured to the boot plate 109 by screws, bolts or other appropriate fasteners that extend through holes 115 on both sides of the boot 112 and engage threaded openings in the boot plate 109. The alignment of the boot 112 on the boot plate 109 may be adjusted for the preference of the rider of the sliding board 133. For example, the boot 112 may be mounted so that the rider's foot is substantially perpendicular to the longitudinal axis of the sliding board 133. The boot 112 may be rotated clockwise or counterclockwise to allow the foot of the rider to point toward the front or back of the sliding board 133. For instance, the boot may be rotated up to about 30 degrees from the perpendicular. The position of the boot 112 may be fixed based upon the locations of the holes 115 in the boot plate 109 and the boot 112. In addition, the two boots 112 on the sliding board 133 may be aligned independently for comfort and control of the rider.

The mounting plate assembly 103 includes a wedge block 124 and a spring mechanism 127 secured to a mounting plate 130, which is affixed to the sliding board 133. The wedge 118 fits into a recess of the wedge block 124 while the spring mechanism 127 applies pressure to the socket 121 on the other side of the boot plate 109. The applied pressure holds the boot plate assembly 106 in place on the mounting plate assembly 103. When sufficient force is applied, the force overcomes the applied pressure of the spring mechanism 127 and the boot plate assembly 106 is released from the mounting plate assembly 103. In this way, the releasable binding system 100 can prevent injury to the rider of the sliding board 133.

Figure 2A:
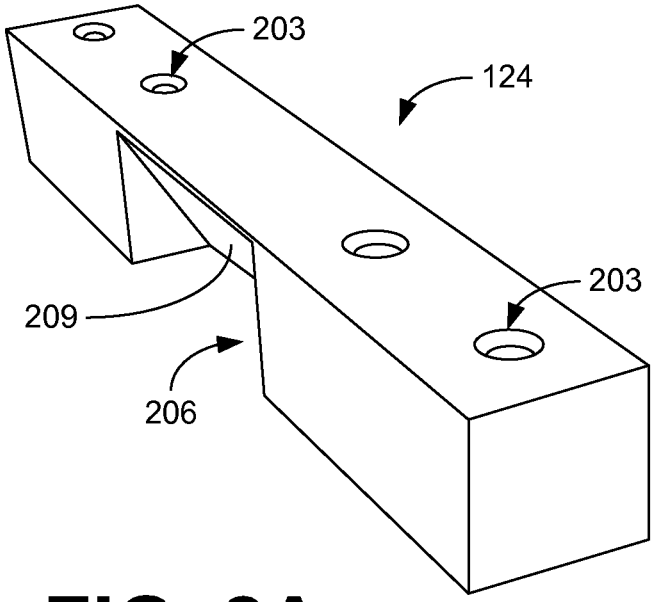
FIGS. 2A and 2B are perspective views of examples of a wedge block and wedge, respectively, used in the binding system of FIG. 1 in accordance with various embodiments of the present disclosure.
Figure 2B:
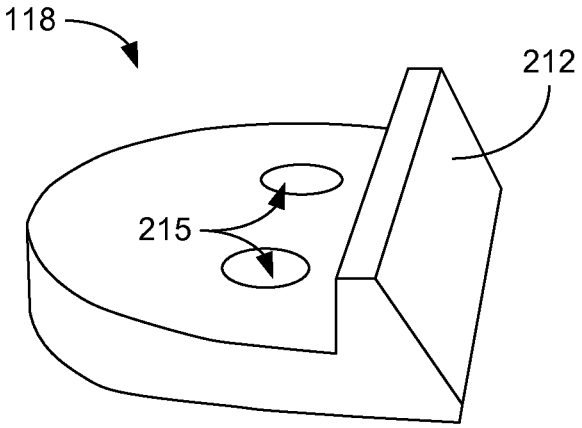

Referring to FIGS. 2A and 2B, shown are examples of the wedge block 124 and wedge 118, respectively. The wedge block 124 can be affixed to the mounting plate 130 by screws or other appropriate fastener that extends through the mounting plate 130 (FIG. 1) and engage threaded openings 203 in the wedge block 124. As illustrated in FIG. 2A, the wedge block 124 includes a tapered recess 206 that is substantially centered along one side of the wedge block 124. The inner surface 209 of the recess 206 linearly tapers into the wedge block 124 at a predefined angle from the top to the bottom, which secured to the mounting plate 130. For example, the linear taper may be at an angle in the range from about 50 degrees to about 75 degrees from the surface of the mounting plate 130. The wedge block is mounted substantially perpendicular (at about 90 degrees) to the longitudinal axis of the spring mechanism 127 and flat to the mounting plate 130. In some implementations, the wedge block 124 may include a second tapered recess (not shown) on the opposite side of the wedge block 124. As illustrated in FIG. 2B, the wedge 118 includes a tapered surface 212 that, when inserted into the tapered recess 206, abuts the inner surface 209 of the tapered recess 206. The wedge 118 can be affixed to the boot plate 109 by screws, bolts or other appropriate fasteners. The fasteners can extend through openings 215 in the wedge 118 and engage threaded openings in the boot plate 109. The boot plate 109 may also include an inset on the bottom the plate that is configured to recess at least a portion of the wedge 118.

Figure 3A:
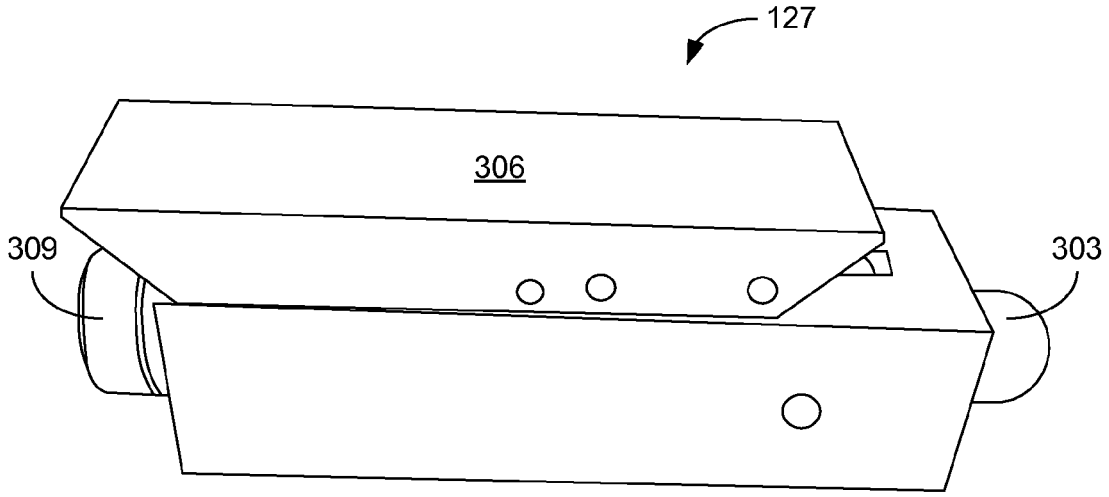
FIGS. 3A and 3B are perspective views of examples of a spring mechanism and socket, respectively, used in the binding system of FIG. 1 in accordance with various embodiments of the present disclosure.
Figure 3B:
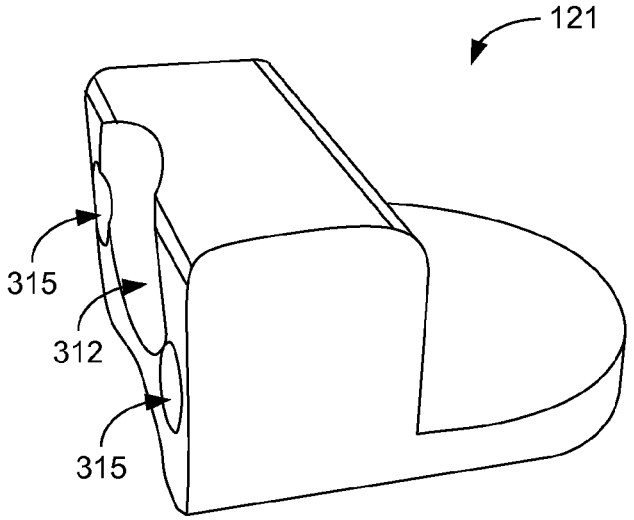

Referring next to FIGS. 3A and 3B, shown are examples of the spring mechanism 127 and socket 121, respectively. The spring mechanism 127 includes a rounded pin 303 that extends from one end of the spring mechanism 127. The rounded pin 303 engages with the socket 121 to hold the boot plate assembly 106 in position on the mounting plate assembly 103 as shown in FIG. 1. A spring (not shown) within the spring mechanism 127 applies force to the rounded pin 303 to keep it extended. The spring mechanism 127 also includes a release lever 306 that allows the spring force to be reduced so that the boot plate assembly 106 may be disengaged from the mounting plate assembly 103 by the rider. When the release lever 306 is pulled up into an "unlocked" position, the force applied on the rounded pin 303 by the spring is reduced making it easier to disengage the rounded pin 303 from the socket 121. When the release lever 306 is pushed down into a "locked" position as shown in FIG. 3A, the spring force is increased. The amount of spring force applied to the pin may be adjusted by turning an adjustment knob 309 at the back of the spring mechanism 127.

As mentioned, when the boot plate assembly 106 is in position on the mounting plate assembly 103 the spring mechanism 127 engages the socket 121. The rounded pin 303 engages with a recess 312 of the socket 121 shown in FIG. 3B. The socket 121 can be affixed to the boot plate 109 using screws, bolts or other appropriate fasteners. The fasteners can extend through openings 315 in the socket 121 and engage threaded openings in an edge of the boot plate 109. The boot plate 109 may also include an inset on the bottom the plate that is configured to recess at least a portion of the socket 121.

The boot 112 and boot plate assembly 106 may be attached to the board 133 by inserting the wedge 118 into the tapered recess 206 in the wedge block 124 and pressing down on the boot plate assembly 106 with the socket 121 aligned with the spring mechanism 127. With the release lever 306 in the "unlocked" position, the rounded pin 303 engages with the recess 312 of the socket 121. The release lever 306 may then be pressed down into the "locked" position to lock the boot 112 in position on the board 133. In this way, the boot 112 is held in position with respect to the longitudinal axis of the board 133. The boot 112 may be adjusted in a clockwise or counter-clockwise fashion to suit the rider's preference.

Referring back to FIG. 1, the spring mechanism 127 applies a force on the socket 121, which is translated through the boot plate 109 to the wedge 118. The force presses the wedge 118 against the inner surface 209 (FIG. 2A) of the tapered recess 206 in the wedge block 124. The angle of the inner surface 209 and the tapered surface 212 (FIG. 2B) of the wedge 118 causes one side of the boot plate 109 to be pressed against the mounting plate 130, holding the boot plate assembly 106 in position on the sliding board 133. The pressure applied by the rounded pin 303 (FIG. 3A) of the spring mechanism 127 to the recess 312 (FIG. 3B) of the socket 121 holds the other side of the boot plate assembly 106 in position on the sliding board 133. When sufficient force is applied to the boot plate assembly 106 though the boot 112, the socket 121 is pulled free of the rounded pin 303 and the boot plate assembly 106 with the boot 112 is released from the sliding board 133.

Figure 4A:
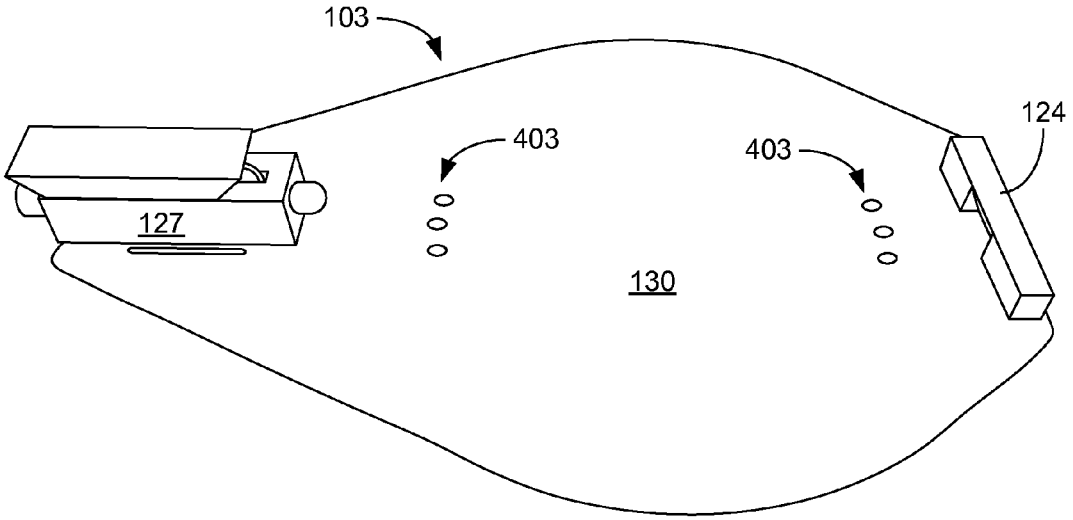
FIG. 4A is a perspective view of an example of a mounting plate assembly of the binding system of FIG. 1 in accordance with various embodiments of the present disclosure.

FIG. 4A shows an example of the mounting plate assembly 103 without the boot plate assembly 106 attached. The spring mechanism 127 is attached at one end of the mounting plate 130 and the wedge block 124 is attached at the other end. The wedge block 124, spring mechanism 127 and mounting plate 130 may be made from corrosion resistant materials such as, e.g., aluminum. The mounting plate 130 includes a plurality of mounting holes 403 for mounting to the sliding board 133 (FIG. 1). The mounting holes 403 may be configured to conform with standard mounting arrangements such as, e.g., in existing snowboard and/or wakeboard designs. When affixed to the sliding board 133, the spring mechanism 127 may be substantially aligned with the longitudinal axis of the board.

Figure 4B:
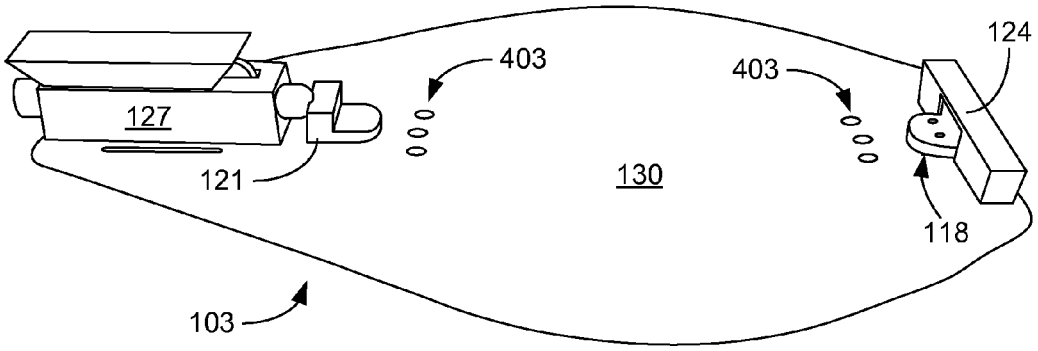
FIG. 4B is a perspective view of an example of a mounting plate assembly of FIG. 4A illustrating the positioning of the wedge and socket of FIGS. 2B and 3B, respectively, in accordance with various embodiments of the present disclosure.

FIG. 4B illustrates the positioning of the wedge 118 and the socket 121 with respect to the wedge block 124 and spring mechanism 127, respectively, without including the boot plate 109. The spring mechanism 127 applies a force on the socket 121, which is translated through the boot plate 109 (FIG. 1) to the wedge 118. The force presses the wedge 118 into the tapered recess 206 (FIG. 2A) in the wedge block 124. The boot plate 109 may be made from corrosion resistant materials such as, e.g., aluminum or a polycarbonate plastic. The wedge 118 and socket 121 can also be made from corrosion resistant materials such as, e.g., aluminum or other suitable material. In some implementations, the wedge 118 and socket 121 can be made of a polycarbonate plastic. Other parts may also be made of similar plastics, carbon fiber, fiberglass, or composite materials.

When mounted on a sliding board 133 (FIG. 1) such as a snowboard or wakeboard, the pair of mounting plate assemblies 103 may be mounted in the same orientation (e.g., both have the spring mechanisms 127 towards the same end of the board) or may be mounted in opposite orientations (e.g., the spring mechanisms 127 mounted towards opposite ends of the board). The pair of mounting plate assemblies 103 can be equally spaced about the center of the snowboard.

Figure 5:
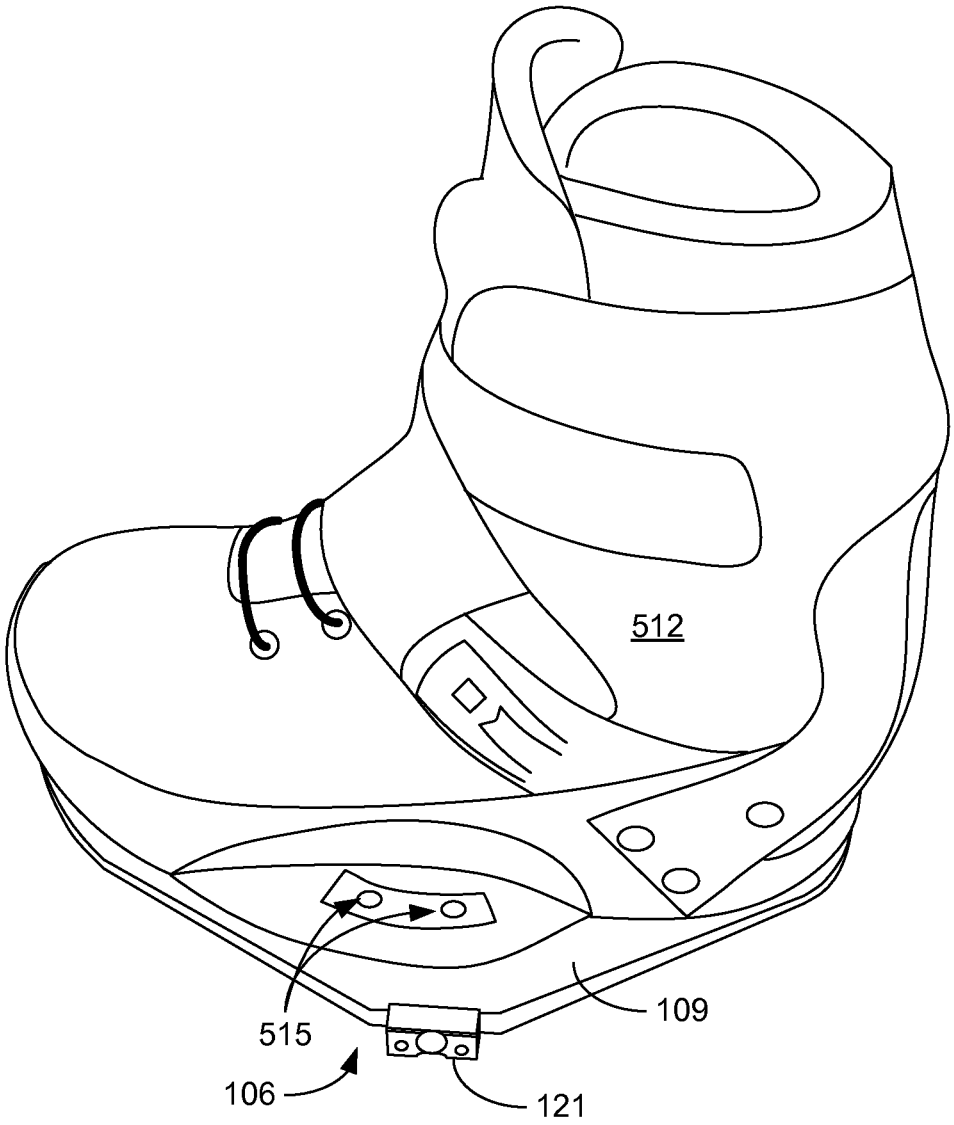
FIG. 5 is a perspective view of an example of the boot plate assembly of FIG. 1 mounted to a snowboard or wakeboard boot in accordance with various embodiments of the present disclosure.

FIG. 5 is a perspective view of a snowboard or wakeboard boot 512 mounted on the boot plate assembly 106. The boot 512 can be secured to the boot plate 109 by screws, bolts or other appropriate fasteners that extend through holes 515 on both sides of the boot 512 and engage threaded openings in the boot plate 109. Other types of mounting openings that align with the threaded openings in the boot plate 109 may also be used. When the boot plate assembly 106 is secured to the sliding board by the mounting plate assembly 103, the boot 512 is held in position relative to the board. The alignment of the boot 512 on the boot plate 109 may be adjusted to account for the rider's preference. For example, the boot 512 may be mounted so that the rider's foot is substantially perpendicular to the longitudinal axis of the sliding board as illustrated in FIG. 5. The boot 512 may also be rotated clockwise or counterclockwise and secured in place on the boot plate 109 to allow the foot of the rider to point toward the front or back of the sliding board. For instance, the boot may be rotated up to about 30 degrees from the perpendicular. The position of the boot 512 may be fixed based upon the locations of the holes in the boot plate 109 and the boot 512. In addition, the two boots 512 on the sliding board may be aligned independently for comfort and control of the rider.

Figure 6:
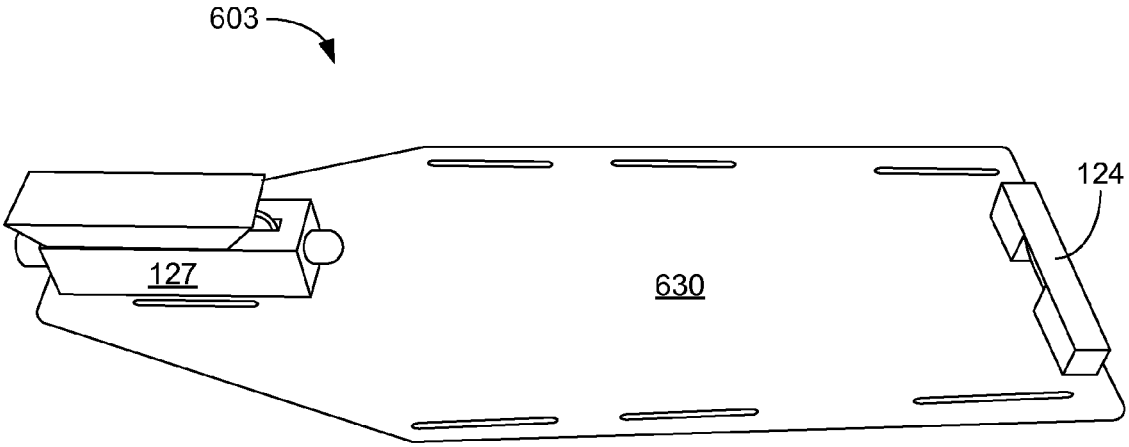
FIG. 6 is a perspective view of an example of a mounting plate assembly of a binding system for use on a ski in accordance with various embodiments of the present disclosure.

The releasable bindings may also be utilized on water skis. Because of the different shape of the skis and positioning of the feet on the skis, the mounting plate and boot plate configurations are modified to conform to the dimensions of the ski. Referring to FIG. 6, shown is an example of a mounting plate assembly 603 for a single boot. The mounting plate assembly 603 includes a spring mechanism 127 attached at one end of the mounting plate 630 and a wedge block 124 attached at the other end. The wedge block 124, spring mechanism 127 and mounting plate 630 may be made from corrosion resistant materials such as, e.g., aluminum. The mounting plate 630 includes a plurality of mounting holes or slots for mounting to the ski. The mounting holes may be configured to conform with standard mounting arrangements such as, e.g., in existing water skis and/or snow skis designs.

As previously discussed, FIGS. 2A and 3A illustrate examples of the wedge block 124 and spring mechanism 127 as previously described. The wedge block 124 and spring mechanism 127 can be affixed to the mounting plate 630 by, e.g., screws that pass through openings in the mounting plate 630 and engage threaded openings in the bottoms of the wedge block 124 and spring mechanism 127. Other appropriate fastening means may also be used to secure the wedge block 124 and spring mechanism 127 to the mounting plate 630.

Figure 7:
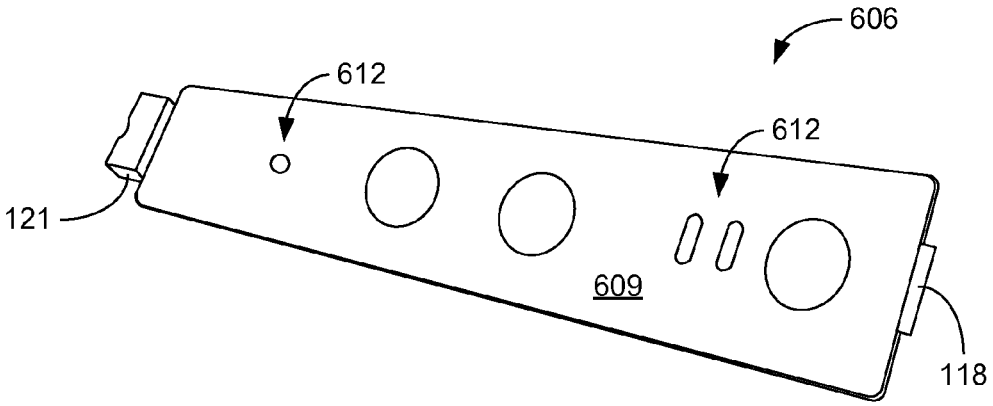
FIG. 7 is a perspective view of an example of a boot plate assembly of a binding system for use on a ski in accordance with various embodiments of the present disclosure.

FIG. 7 illustrates an example of a boot plate assembly 606 configured for use with the mounting plate assembly 630 of FIG. 6. The boot plate assembly 606 includes a wedge 118 and a socket 121 secured to opposite ends of a boot plate 609. The wedge 118 and socket 121 allow the boot plate assembly 606 to be held in position on the mounting plate assembly 603. FIGS. 2B and 3B illustrate examples of the wedge 118 and socket 121 as previously described. The boot plate 609 can include holes and/or slots 612 that allow the boot plate 609 to be detachably attached to the bottom of a boot as illustrated in FIG. 8 using screws, bolts or other appropriate fasteners.

The wedge 118 and socket 121 can be affixed to the boot plate 609 by, e.g., screws, bolts or other appropriate fasteners that pass through the wedge 118 and/or socket 121 and engage threaded openings in the boot plate 609. For example, the wedge 118 can be affixed to the boot plate 609 by screws, bolts or other appropriate fasteners. The fasteners can extend through openings 215 (FIG. 2B) in the wedge 118 and engage threaded openings in the boot plate 609. The boot plate 609 may also include an inset on the bottom the plate that is configured to recess at least a portion of the wedge 118.

The socket 121 can also affixed to the boot plate 609 using screws, bolts or other appropriate fasteners. The fasteners can extend through openings 315 (FIG. 3B) in the socket 121 and engage threaded openings in an edge of the boot plate 609. The boot plate 609 may also include an inset on the bottom the plate that is configured to recess at least a portion of the socket 121.

Figure 8:
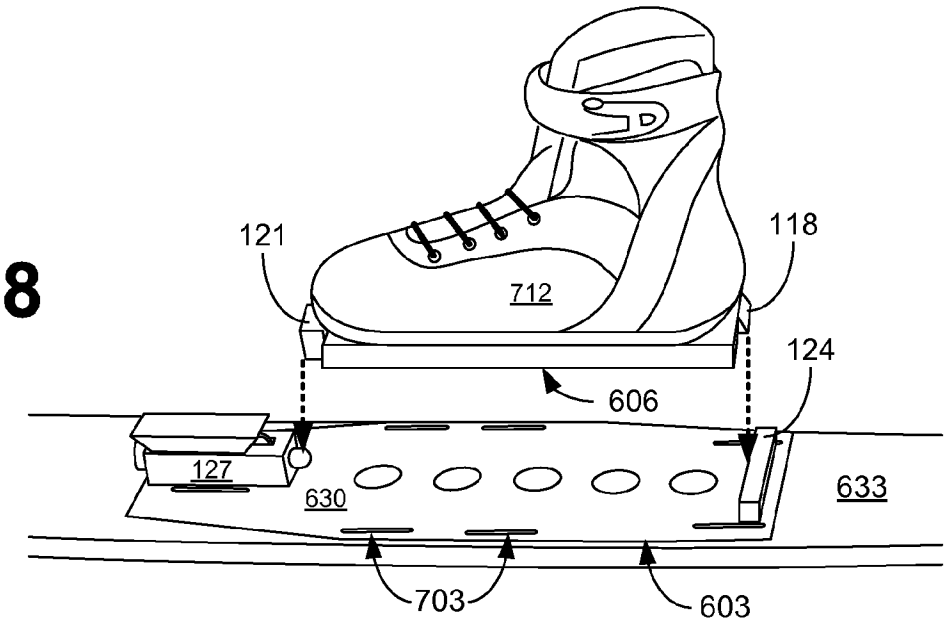
FIG. 8 is a perspective view of an example of the binding system of FIGS. 6 and 7 mounted on a ski in accordance with various embodiments of the present disclosure.

Referring next to FIG. 8, the mounting plate assembly 603 for a single boot is shown attached to a ski 633 such as, e.g., a water ski. As depicted in FIG. 8, the mounting plate assembly 603 is aligned with the longitudinal axis of the ski 633. In the example of FIG. 8, the mounting plate 630 is secured to the ski 633 with screws, bolts or other appropriate fasteners extending through the slots 703 in the mounting plate 630. When affixed to the ski, the spring mechanism 127 is substantially aligned with the longitudinal axis of the ski 633 and the wedge block 124 is substantially perpendicular to the longitudinal axis of the ski 633.

The boot plate assembly 606 is attached to the bottom of a boot 712 such as, e.g., a molded inline skate boot or molded waterski boot. The boot plate assembly 606 may be detachably attached to the boot 712 by, e.g., screws, bolts or other appropriate fasteners that extend through holes and/or slots 612 in the boot plate 609 (FIG. 7) into threaded opening in the sole of the boot 712. The boot 712 and boot plate assembly 606 may be attached to the ski 633 by inserting the wedge 118 into the tapered recess 206 (FIG. 2A) in the wedge block 124 and pressing down on the boot plate assembly 606 with the socket 121 aligned with the spring mechanism 127. With the release lever 306 in the "unlocked" position, the rounded pin 303 (FIG. 3A) engages with the recess 312 (FIG. 3B) of the socket 121. The release lever 306 may then be pressed down into the "locked" position to lock the boot 712 in position on the ski 630.

The spring mechanism 127 applies a force on the socket 121, which is translated through the boot plate 609 (FIG. 7) to the wedge 118. The force presses the wedge 118 against the inner surface 209 (FIG. 2A) of the tapered recess 206 in the wedge block 124. The angle of the inner surface 209 and the tapered surface 212 (FIG. 2B) of the wedge 118 causes the boot plate 609 to be pressed against the mounting plate 630, holding the boot plate assembly 606 in position on the ski 633. The pressure applied by the rounded pin 303 of the spring mechanism 127 to the recess 312 of the socket 121 holds the other side of the boot plate assembly 606 in position on the ski 633. When sufficient force is applied to the boot plate assembly 606 though the boot 712, the socket 121 is pulled free of the rounded pin 303 and the boot plate assembly 606 with the boot 712 is released from the ski 633. As can be understood, each of a pair of skis 633 can include a mounting plate assembly 603 secured to the ski.

Figure 9:
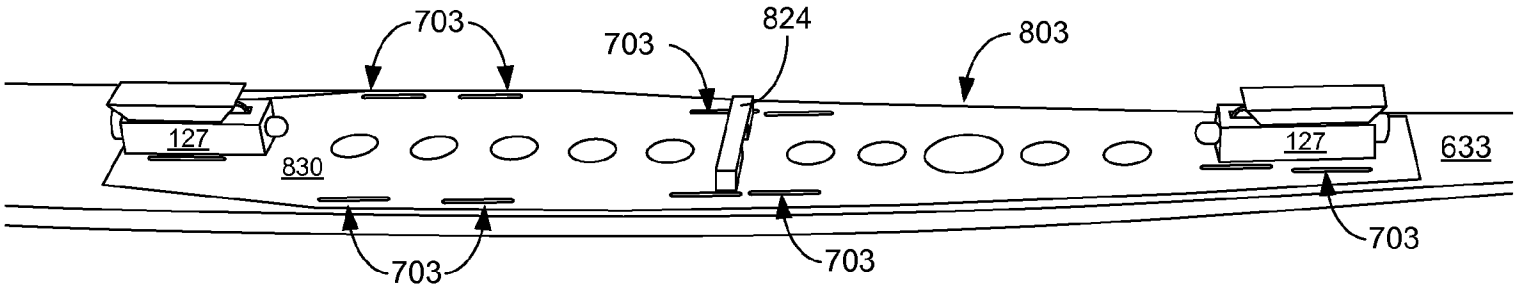
FIG. 9 is a perspective view of an example of a slalom binding system for use on a ski in accordance with various embodiments of the present disclosure.

FIG. 9 shows an example of a slalom mounting plate assembly 803 that is configured to support slalom skiing by holding a pair of boots on the ski 633. The slalom mounting plate assembly 803 includes two spring mechanisms 127 and a wedge block 824 secured to an extended mounting plate 830. The wedge block 824, which is affixed to the middle of the extended mounting plate 830, includes tapered recesses 206 (FIG. 2A) on both sides of the wedge block 824. The spring mechanisms 127 are mounted on opposite ends of the extended mounting plate 830 with the spring mechanisms facing in opposite directions (i.e., with the rounded pin 303

(FIG. 3A) extending toward the wedge block 824. As can be seen in FIG. 8, the shape of the extended mounting plate 830 is configured to conform to the shape of the ski 633.

In the example of FIG. 9, the extended mounting plate 830 is secured to the ski 633 with screws, bolts or other appropriate fasteners extending through the slots 703 in the mounting plate 830. When affixed to the ski 633, the spring mechanisms 127 is substantially aligned with the longitudinal axis of the ski 633 and the wedge block 824 is substantially perpendicular to the longitudinal axis of the ski 633. The boot plate assembly 606 for the forward boot 712 has the socket 121 positioned at the toe of the boot 712 and the wedge 118 positioned at the heel of the boot 712 as illustrated in FIG. 7. The boot plate assembly 606 for the rear boot has the wedge 118 positioned at the toe of the boot 712 and the socket 121 positioned at the heel of the boot 712. In this way, a single wedge block 824 with tapered recesses 206 (FIG. 2A) on both sides can be used to hold the heel of the forward boot and the toe of the rear boot in position on the ski 633.

While the binding systems of FIGS. 6-9 have been discussed with respect to water skis, the systems may also be used for snow skis. For example, bindings on existing skis may be replaced with the binding system described with respect to FIGS. 6-8. The bindings may also be used on new skis.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A binding system for a sliding board, comprising:

a boot plate assembly comprising a boot plate affixed to a boot, the boot plate comprising a top surface that is mounted flush with a bottom surface of the boot, the top surface extending over a heel-to-toe length of the boot, a wedge affixed to the boot plate on a first side of the heel-to-toe length of the boot and a socket affixed to the boot plate on a second side of the heel-to-toe length of the boot, the boot plate comprising a first axis extending between the wedge and the socket and a second axis extending perpendicular to the first axis, where the boot can be affixed to the boot plate in a plurality of rotational orientations about the second axis; and a mounting plate assembly affixed to the sliding board, the mounting plate assembly comprising:

a wedge block substantially perpendicular to a longitudinal axis of the sliding board, the wedge block including a tapered recess configured to receive the wedge; and a spring mechanism substantially aligned with the longitudinal axis of the sliding board, the spring mechanism configured to engage the socket, wherein the boot plate assembly is secured to the sliding board by the spring mechanism in a locked position and the wedge block, where the first axis of the boot plate is substantially aligned with the longitudinal axis of the sliding board when secured to the mounting plate assembly, and where the spring mechanism is configured to release the boot plate assembly from the mounting plate assembly with the spring mechanism in the locked position when a force applied to the spring mechanism via the boot plate and socket exceeds a threshold defined by adjustment of the spring mechanism.

2. The binding system of claim 1, wherein the boot is substantially perpendicular to the longitudinal axis of the sliding board when the boot plate assembly is secured to the sliding board.

3. The binding system of claim 1, wherein the tapered recess of the wedge block comprises a tapered portion that linearly tapers from top to bottom at an angle in a range from about 50 degrees to about 75 degrees from a top surface of the mounting plate and the wedge comprises a tapered portion that linearly tapers from top to bottom at an angle that is substantially aligned with the tapered portion of the wedge block when the boot plate assembly is secured to the mounting plate assembly.

4. The binding system of claim 3, wherein the boot plate is configured to affix the boot to the boot plate at a fixed angle between the first axis and the second axis of the boot plate.

5. The binding system of claim 4, wherein the fixed angle is one of a plurality of predefined fixed angles in a range of about 30 degrees to about −30 degrees with respect to the second axis of the boot plate.

6. The binding system of claim 1, wherein the sliding board is a wakeboard, wherein the mounting plate is affixed to the wakeboard using a standard wakeboard mounting arrangement.

7. The binding system of claim 1, wherein the boot is a wakeboard boot that is affixed to the boot plate by fasteners extending through mounting holes on opposite sides of the wakeboard boot.

8. The binding system of claim 1, further comprising a second mounting plate assembly affixed to the sliding board, the second mounting plate assembly comprising:

a wedge block substantially perpendicular to a longitudinal axis of the sliding board; and a spring mechanism substantially aligned with the longitudinal axis of the sliding board.

9. The binding system of claim 8, wherein the first and second mounting plate assemblies are equally spaced about a center of the sliding board.

10. The binding system of claim 8, wherein the first and second mounting plate assemblies are affixed to the sliding board with the wedge block of the first mounting plate assembly adjacent to the wedge block of the second mounting plate assembly.

11. The binding system of claim 8, wherein the first and second mounting plate assemblies are affixed to the sliding board with the wedge block of the first mounting plate assembly adjacent to the spring mechanism of the second mounting plate assembly.

12. The binding system of claim 8, further comprising a second boot plate assembly comprising:

a second boot plate affixed to a second boot;

a wedge affixed to the second boot plate on a first side of the second boot, where the wedge block of the second mounting plate assembly includes a tapered recess configured to receive the wedge of the second boot plate assembly; and a socket affixed to the second boot plate on a second side of the second boot where the spring mechanism of the second mounting plate assembly is configured to engage the socket, wherein the second boot plate assembly is secured to the sliding board by the spring mechanism and the wedge block of the second mounting plate assembly.

13. The binding system of claim 12, wherein the first boot is affixed to the first boot plate in a counterclockwise orientation from the second axis and the second boot is affixed to the second boot plate in a clockwise orientation from a second axis extending perpendicular to a first axis extending between the wedge and the socket of the second boot plate assembly.

14. The binding system of claim 1, wherein the mounting plate assembly comprises a mounting plate that is affixed to the sliding board, the mounting plate having a length extending along the longitudinal axis of the sliding board from a first end adjacent to a center of the sliding board to a second end, where the wedge block is attached to the mounting plate at the first end and the spring mechanism is attached to the mounting plate at the second end.

15. The binding system of claim 14, wherein a width of the mounting plate is greater than the heel-to-toe length of the boot.

16. A binding system for skis, comprising:

a boot plate assembly comprising a boot plate affixed to a boot, the boot plate comprising a top surface that is mounted flush with a bottom surface of the boot, the top surface extending over a heel-to-toe length of the boot, a wedge affixed to the boot plate adjacent to a heel of the boot and a socket affixed to the boot plate adjacent to a toe of the boot; and a mounting plate assembly affixed to a ski, the mounting plate assembly comprising:

a wedge block substantially perpendicular to a longitudinal axis of the ski, the wedge block including a first tapered recess configured to receive the wedge;

a first spring mechanism located between the wedge block and a front tip of the ski, the spring first mechanism substantially aligned with the longitudinal axis of the ski, the first spring mechanism configured to engage the socket, wherein the boot plate assembly is secured to the ski by the first spring mechanism and the wedge block; and a second spring mechanism located between the wedge block and a rear end of the ski, the second spring mechanism substantially aligned with the longitudinal axis of the ski, and the wedge block comprises the first tapered recess including a tapered portion that linearly tapers from top to bottom at an angle in a range from about 50 degrees to about 75 degrees from a top surface of the mounting plate and a second tapered recess opposite the first tapered recess, the second tapered recess including a tapered portion that linearly tapers opposite the taper of the first tapered recess at the angle of the first tapered recess.

17. The binding system of claim 16, further comprising a second boot plate assembly comprising a second boot plate affixed to a second boot, a wedge affixed to the second boot plate adjacent to a toe of the second boot and a socket affixed to the second boot plate adjacent to a heel of the second boot, wherein the second boot plate assembly is secured to the ski by the second spring mechanism and the wedge block.

18. The binding system of claim 16, wherein the mounting plate assembly comprises a mounting plate affixed to the ski, the mounting plate having a length extending along the longitudinal axis of the ski from a first end to a second end, where the first spring mechanism is attached to the mounting plate at the first end, the second spring mechanism is attached to the mounting plate at the second end, and the wedge block is attached to the mounting plate at a center point between the first and second spring mechanisms.

19. The binding system of claim 16, wherein the boot is a molded inline skate boot that is affixed to the boot plate by fasteners extending through the boot plate and engaging with a sole of the molded inline skate boot.

* * * * *